United States Patent [19]

Dumke

[11] 4,402,144

[45] Sep. 6, 1983

[54] SILICONE MILK BATH UNIT

[76] Inventor: Jean A. Dumke, 7525 N. 107th St., Milwaukee, Wis. 53224

[21] Appl. No.: 296,464

[22] Filed: Aug. 26, 1981

[51] Int. Cl.[3] ..... F26B 9/00

[52] U.S. Cl. ..... 34/192; 34/193; 99/446; 312/229

[58] Field of Search ..... 312/229; 34/193, 195, 34/196, 197, 192; 99/444, 446; 118/58

[56] References Cited

U.S. PATENT DOCUMENTS

| | | | |
|---|---|---|---|
| 1,704,912 | 3/1929 | Bussler | 34/193 |
| 1,925,210 | 9/1933 | Smith | 34/195 |
| 2,635,027 | 4/1953 | Rasmussen | 312/229 |

*Primary Examiner*—Larry I. Schwartz

*Attorney, Agent, or Firm*—Andrus, Sceales, Starke & Sawall

[57] ABSTRACT

A silicone milk bath unit for coating surgical instruments with silicone includes a sink where the instruments are submerged in a silicone solution, and a cabinet for drying the instruments. The drying cabinet is divided into a plurality of compartments one above the other, each having a track for slidably receiving an instrument tray containing the silicone coated instruments. A drip tray is disposed beneath each instrument tray and collects the excess solution that drips from the instruments. The drip tray is inclined downwardly toward the rear of the cabinet and is positioned so that liquid dripping from its rear edge avoids falling onto the instruments located in the lower compartments, but instead falls down to the bottom of the cabinet for disposal.

5 Claims, 4 Drawing Figures

SILICONE MILK BATH UNIT

BACKGROUND OF THE INVENTION

This invention relates to surgical instruments, and more particularly to coating surgical instruments with a silicone solution.

Surgical instruments are coated with a silicone solution to avoid pitting the surface and to lubricate certain instruments having moving parts such as clamps. In the past, surgical instruments have been placed on a mesh surface of a tray which is located in a shallow tub and the silicone solution is simply sprayed on the instruments by utilizing a baster-like device having a glass tube with a rubber bulb at one end. The excess solution drips through the mesh surface into the tub, and the instruments are allowed to air dry. Another manner of coating surgical instruments is to simply dip the instruments in a silicone solution and place them on a table for drying.

The problem with these methods of coating surgical instruments is that air drying is a relatively slow process, and only a small number of instruments may be coated at a time. It is thus desirable to provide an apparatus which will decrease drying time while increasing the number of instruments that may be coated.

SUMMARY OF THE INVENTION

The present invention provides an apparatus for drying surgical instruments coated with a silicone solution. The apparatus includes a housing, an instrument tray disposed in the housing having a surface that supports the instruments and permits excess solution to drip therethrough, means on the housing for supporting the instrument tray, and a drip tray disposed beneath the supporting surface of the instrument tray and positioned so that silicone solution dripping from instruments in an instrument tray is collected thereby.

In one aspect of the invention, the housing is in the form of a cabinet divided into a plurality of instrument-tray receiving compartments one above the other with each compartment including an instrument tray supporting means. A drip tray is disposed beneath all of the compartments except for the lowermost compartment. Each drip tray is inclined downwardly toward the rear of the cabinet, and is located so that it collects the excess silicone solution that drips from the instruments directly above it. Each drip tray also is positioned so that liquid dripping from its rear edge avoids falling onto the instruments located in the lower compartments, but instead falls down to the bottom of the cabinet for disposal. It is not necessary to provide a drip tray beneath the lowermost compartment since there are no instruments positioned beneath it, and the excess solution is allowed to drip directly onto the bottom of the cabinet.

The apparatus of the present invention includes a sink positioned adjacent to the cabinet where the instruments are submerged in the silicone solution. Such an arrangement permits numerous surgical instruments to be placed on instrument trays, submerged into the silicone solution, and conveniently placed in the compartments of the drying cabinet. Once placed within the drying cabinet, the surgical instruments may be air dried or a fan may be attached to the cabinet to decrease drying time.

The present invention thus provides an improved apparatus for coating surgical instruments with silicone to increase the life of the instruments and to provide ease of operation for a surgeon. The apparatus increases the number of instruments that may be coated at one time while decreasing their drying time.

Other advantages will appear during the course of the following description.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
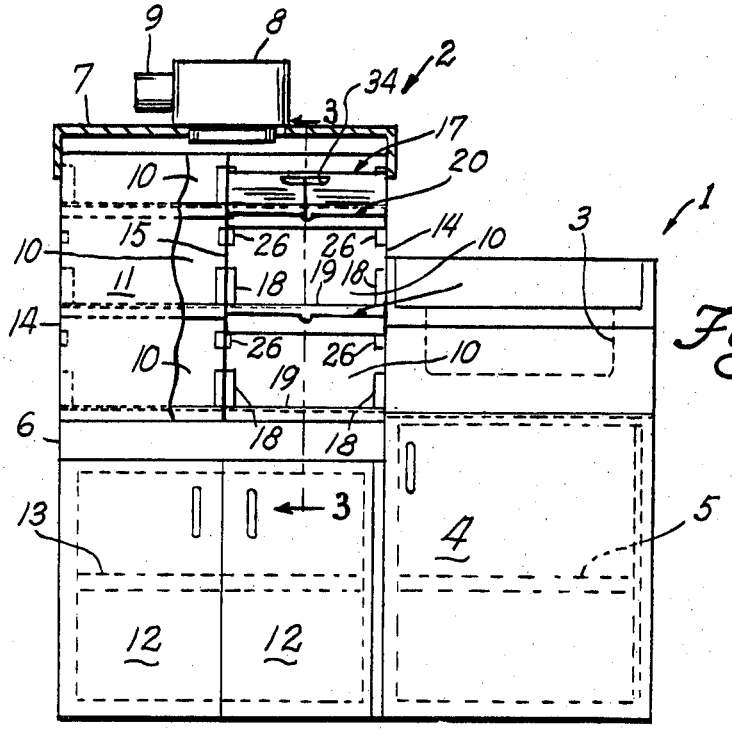
FIG. 1 is a view in elevation with parts broken away of a silicone bath unit constituting a preferred embodiment of the present invention.

Referring to the drawings, FIG. 1 illustrates a silicone milk bath unit for coating surgical instruments with silicone in accordance with the present invention. The bath unit includes a bath section 1 where the instruments are submerged in a silicone solution, and a drying section 2 where the instruments are placed for drying.

The bath section 1 is preferably formed of stainless steel and is in the form of a vanity having a sink 3 in its upper portion, and a hinged door 4 which swings open to reveal a shelf 5 in the interior of its lower portion. The shelf 5 may be used for storing various materials, for example, the silicone solution used to coat the surgical instruments. It should be noted that as shown bath section 1 is positioned adjacent to and connected with drying section 2. However, it need not necessarily be attached to drying section 2, but instead may be a separate unit which can be positioned wherever convenient in a room.

The drying section 2 is also preferably formed of stainless steel and includes a housing or cabinet 6 which is divided into an upper portion and a lower portion. The cabinet 6 includes a cover 7 to enclose its top. A fan 8 is mounted on the cover 7 and is positioned to draw air through the upper portion of cabinet 6 and exhaust the air through its outlet 9. The purpose of fan 8 is to decrease drying time of surgical instruments placed within cabinet 6 as will hereinafter be more fully described.

The upper portion of cabinet 6 is divided into six compartments 10 opening toward the front of cabinet 6. The compartments 10 are arranged in two columns with three compartments in each column, disposed one above the other, so that there is an upper, middle and lower compartment on the left hand side of cabinet 6 and on the right hand side of cabinet 6, as seen in FIG. 1. The front of the upper portion of cabinet 6 may be enclosed by a pair of doors 11 (only one of which is shown in FIG. 1) which are hingedly mounted to the side walls of cabinet 6 to open outwardly and away from each other.

The lower portion of cabinet 6 also includes a pair of doors 12 which open in a manner similar to doors 11. As shown in FIG. 1, the lower portion of cabinet 6 also includes a shelf 13 behind doors 12, and thus the lower portion of cabinet 6 is used primarily for storage of various materials. However, it is readily apparent that the lower portion of cabinet 6 might be converted into additional compartments 10 if desired.

Figure 3:
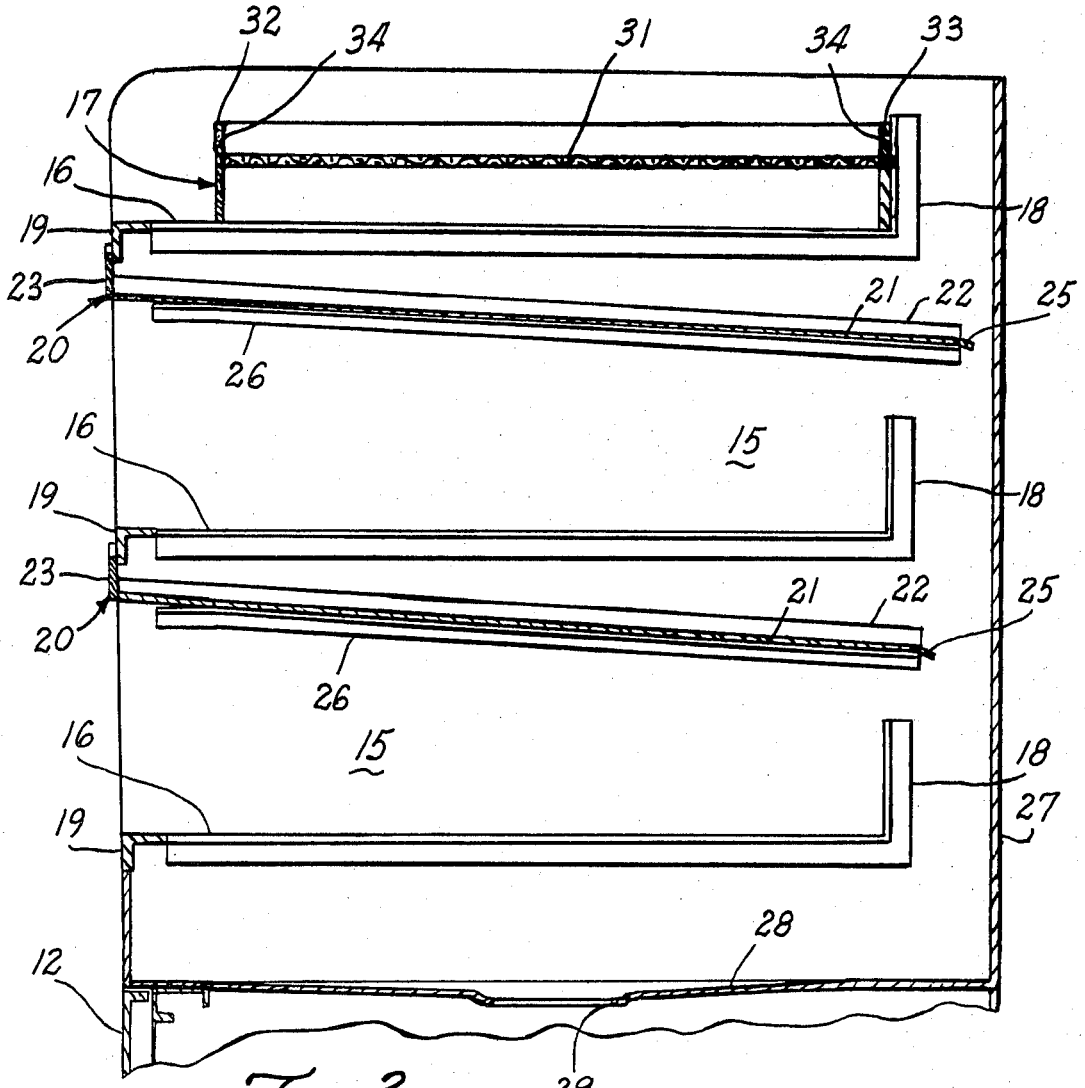
FIG. 3 is a fragmentary view in section taken along the plane of the line 3—3 in FIG. 1.

FIGS. 1 and 3 show that each compartment 10 includes a pair of opposite walls with one wall being a side wall 14 of cabinet 6 and the other wall being a central wall 15 which divides the upper portion of cabinet 6 into a left side and a right side. Each compartment 10 also includes a pair of L-shaped rails 16 which form a track for a removable instrument tray 17. The rails 16 are parallel to one another and are mounted horizontally within cabinet 6 with one rail mounted on side wall 14 and the other rail mounted on central wall 15. As seen in FIG. 3, each rail 16 includes a stop portion 18 which extends vertically upright from its rear edge. This stop portion 18 properly positions the instrument tray 17 within each compartment 10 as will hereinafter be described. An angle member 19 is mounted along the front of each compartment 10 to give added support to the walls 14 and 15 and rails 16.

Figure 5:
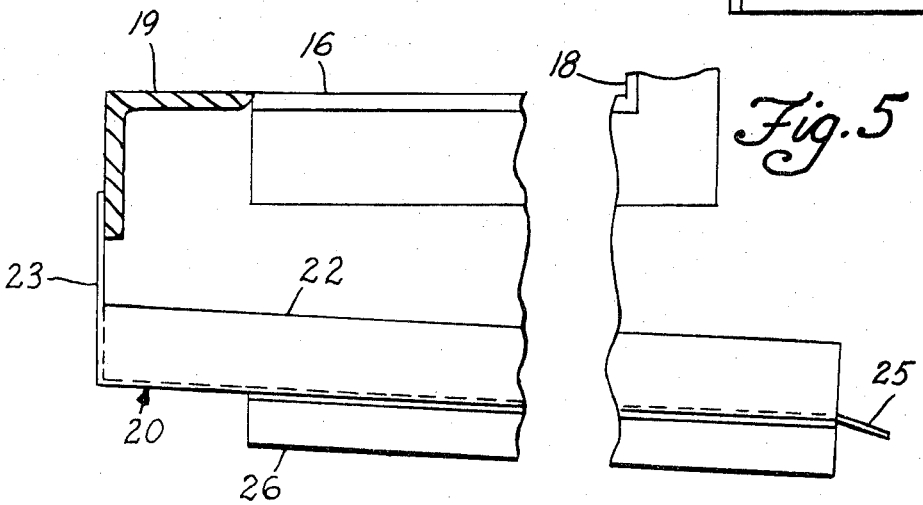
FIG. 5 is an enlarged fragmentary view showing the position of a drip tray within the drying cabinet.
Figure 4:
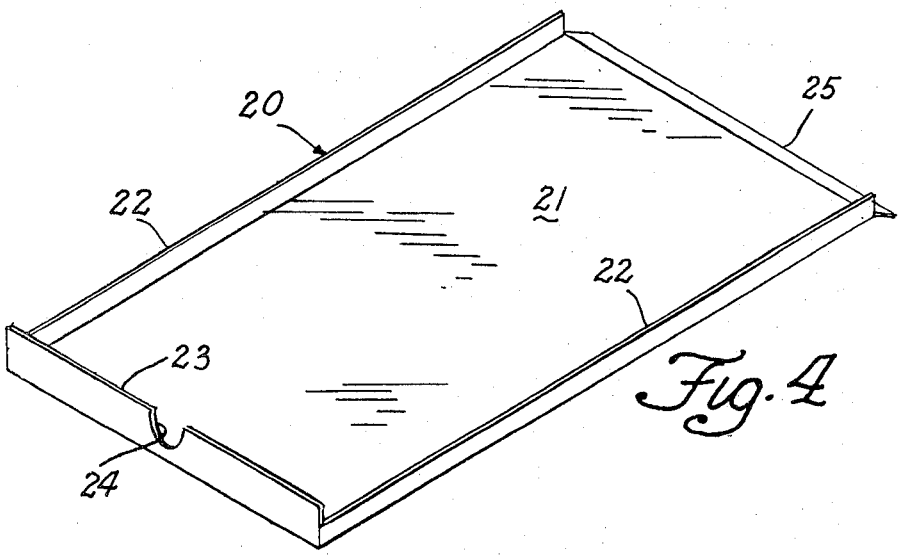
FIG. 4 is a view in perspective of a removable drip tray constituting one component of the drying cabinet.

FIG. 3 also shows a removable drip tray 20 disposed beneath each compartment 10. As shown in FIG. 4, drip tray 20 is in the form of a shallow pan-like structure having a flat bottom 21 and a pair of upstanding side walls 22. Drip tray 20 also includes a front wall 23 which extends upwardly from its bottom 21 and is slightly higher than side walls 22. Front wall 23 includes a finger notch 24 which permits the drip tray 20 to be readily withdrawn from cabinet 6. The rear edge of drip tray 20 is open and includes a lip 25 extending outwardly and downwardly therefrom. As seen in FIGS. 3 and 5, each drip tray 20 is positioned within cabinet 6 so that its rear edge is inclined downwardly with respect to rails 16. Each drip tray 20 is supported within cabinet 6 by means of a pair of L-shaped rails 26 mounted in a manner similar to rails 16 on walls 14 and 15.

As seen in FIGS. 3 and 5, each drip tray 20 is slid into cabinet 6 along rails 26 until the inner surface of its front wall 23 engages the outer surface of angle member 19, and its lip projects over the rear edge of rails 26. As previously noted, drip trays 20 may be removed by inserting one's finger into notch 24 and sliding the tray along the rails 26 until it is removed from the front of cabinet 6.

FIG. 3 also shows that upper drip tray 20 is slightly longer than lower drip tray 20 and is more closely spaced to the rear wall 27 of cabinet 6 than is lower drip tray 20. Both drip trays 20 extend rearwardly beyond the upright stop portion 18 of rails 16 to prevent drippings from the instruments in one compartment 10 from falling onto the instruments in the next lower compartment 10. The upper portion of cabinet 6 also includes a bottom wall 28 having a drain opening 29 therein which may be connected by a rubber hose (not shown) to a drain. Bottom wall 28 tapers downwardly and inwardly toward drain opening 29 and is in the form of a sink so that liquid dripping from drip trays 20 and from the instruments located in the lowermost compartment 10 is collected thereby and directed toward the drain opening 29 for disposal.

Figure 2:
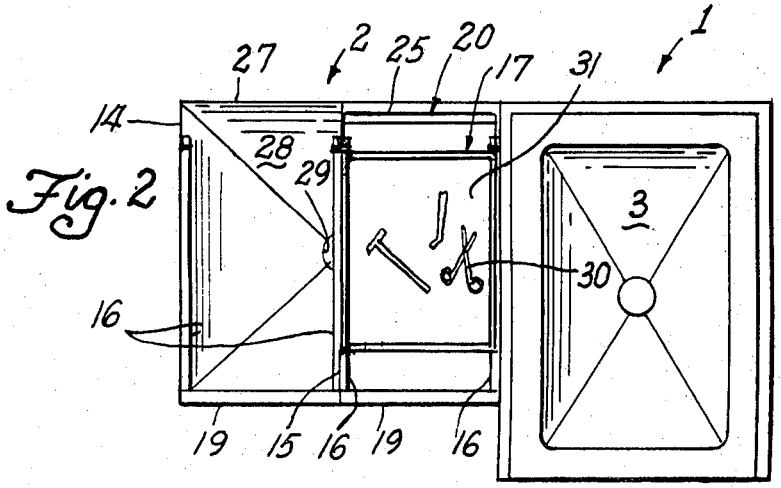
FIG. 2 is a plan view of the bath unit of FIG. 1 with the cover and fan removed from the top of the drying cabinet.

FIG. 2 shows various surgical instruments, such as a clamp 30, placed on an instrument tray 17 which is located within the upper compartment 10 of cabinet 6. Although only one instrument tray 17 is shown in the drawings, it is readily apparent that a tray 17 may be received within each compartment 10, depending upon the number of instruments to be coated. Each instrument tray 17 is slidably removable from the front of cabinet 6 along rails 16 in a manner similar to drip trays 20. Each instrument tray 17 has an open top and an open bottom, and includes a supporting surface 31 surrounded by four walls including a front wall 32 and a rear wall 33. Front wall 32 and rear wall 33 each include a hand opening 34 formed therein which readily permits the trays 17 to be removed from cabinet 6 and easily carried about. Supporting surface 31 is in the form of a mesh or screen which permits excess solution from the instruments supported by surface 31 to drip therethrough onto drip trays 20.

In operation, surgical instruments are placed on supporting surface 31 of an instrument tray 17 and the tray is then placed in sink 3. The instruments are submerged into a silicone solution in the sink thus coating them with a silicone solution. The tray 17 and wet instruments are then placed within the compartments 10 of the upper portion of cabinet 6 by sliding the trays 17 along rails 16 until the rear wall 33 of each tray 17 engages the stop portion 18 of the rails 16. A drip tray 20 may then be slid into position beneath the instrument trays 17 along its corresponding rails 26 until its front wall 23 engages the angle member 19. The above procedure is repeated until the desired number of instruments have been coated with silicone and placed within cabinet 6. The drip trays 20 collect the excess silicone solution dripping from the instruments through the instrument trays 17, and direct the excess solution to the rear of cabinet 6 where it flows down to the bottom wall 28 for disposal. The drip trays 20 prevent the excess silicone solution from the instruments in one compartment from dripping onto the instruments located in another compartment beneath it. It should be noted from FIG. 3 that the lowermost compartment 10 does not have a drip tray 20 positioned beneath it. The lowermost compartment does not need a drip tray since there are no instruments located beneath it and therefore there is no need to collect the excess solution. Thus, the excess solution may drip directly onto the bottom wall 28 from the instruments located in the lowermost compartment 10.

At this point the instruments may be allowed to air dry or the doors 11 may be closed and fan 8 may be actuated so that an air flow is established within cabinet 6 across the surgical instruments to aid in drying. The drying cabinet could also be connected to the in-house vacuum system to expedite the drying. After the surgical instruments are dried, the doors 11 may be opened and the instrument trays 17 may be removed.

The cabinet 6 may be readily cleaned by removing the drip trays 20 and cleaning them in sink 3, and then flushing out the interior of the upper portion of cabinet 6 with water.

A preferred embodiment of an apparatus for drying surgical instruments coated with a silicone solution has been shown and described. However, it will be readily apparent to those skilled in the art that various modifications and substitutions may be made to the components described. Thus, the invention is not limited to the use of a silicone solution, nor is it limited to the use of surgical instruments. Rather, other types of small tools or devices to be coated might be used. For example, it may be desirable to coat small hand tools with a rust preventative solution.

Various modes of carrying out the invention are contemplated as being within the scope of the following claims particularly pointing out and distinctly claiming the subject matter which is regarded as the invention.

I claim:

1. An apparatus for drying surgical instruments or the like coated with a solution, comprising:

a housing having a rear wall, a pair of opposite side walls, a top, a bottom wall having a drain opening therein, and door means providing a closure for the front of said housing;

a plurality of vertically spaced pairs of horizontally extending first supports on said side walls defining tracks for slidably supporting instrument trays thereon, said instrument trays having a perforated surface that supports the coated instruments and permits excess solution to drip therethrough, each of said first supports having an upright stop portion at its rear edge for limiting the extent to which said instrument trays may be slid rearwardly upon said first supports;

a cross member extending between each pair of first supports, each cross member extending longitudinally between the front edges of said pair of first supports and having a downwardly directed flange portion, a plurality of vertically spaced pairs of second supports on said side walls for slidably supporting drip trays thereon, said pairs of second supports located beneath respective pairs of first supports and sloping downwardly and rearwardly so that their rear edges are lower than their front edges; and each of said drip trays includes a lip at its rear edge and an upright wall at its front edge, the lips of downwardly succeeding drip trays being progressively spaced from the rear wall by a greater distance thereby providing a greater space between the lip of the lowermost drip tray and the rear wall than the upper drip trays, and said upright wall extending vertically a sufficient distance to engage the downwardly directed flange portion of said cross members to limit the extent to which said drip trays may be slid rearwardly upon said second supports.

2. The apparatus of claim 1, wherein said first and second supports are L-shaped rails.

3. The apparatus of claim 1, wherein said cross members are L-shaped angle members.

4. The apparatus of claim 1, wherein the upright front wall of said drip trays includes a finger notch which permits said drip trays to be readily slidably withdrawn from said housing.

5. The apparatus of claim 2, wherein the lip of each drip tray projects over the rear edge of its corresponding pair of rails.

* * * * *